US010439316B2

(12) United States Patent
Leonhardt

(10) Patent No.: US 10,439,316 B2
(45) Date of Patent: Oct. 8, 2019

(54) CONTACT AND ELECTRICAL CONNECTOR

(71) Applicant: TE Connectivity Germany GmbH, Bensheim (DE)

(72) Inventor: Bernd Leonhardt, Kirchheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/485,817

(22) Filed: Apr. 12, 2017

(65) Prior Publication Data

US 2017/0294731 A1 Oct. 12, 2017

(30) Foreign Application Priority Data

Apr. 12, 2016 (DE) ..... 10 2016 106 717

(51) Int. Cl.

| | |
|---|---|
| ***H01R 11/22*** | (2006.01) |
| ***H01R 13/436*** | (2006.01) |
| ***H01R 4/18*** | (2006.01) |
| ***H01R 13/11*** | (2006.01) |
| ***H01R 13/432*** | (2006.01) |
| ***H01R 13/53*** | (2006.01) |
| *H01R 13/50* | (2006.01) |

(52) U.S. Cl.

CPC ..... *H01R 13/4361* (2013.01); *H01R 4/184* (2013.01); *H01R 13/11* (2013.01); *H01R 13/432* (2013.01); *H01R 13/53* (2013.01); *H01R 13/113* (2013.01); *H01R 13/501* (2013.01)

(58) Field of Classification Search

CPC ... H01R 13/115; H01R 13/111; H01R 13/113; H01R 4/02; H01R 4/185

USPC ..... 439/850–852, 874, 877

See application file for complete search history.

(56) References Cited

U.S. PATENT DOCUMENTS

| | | | | |
|---|---|---|---|---|
| 2,785,387 | A * | 3/1957 | Batcheller | H01R 13/115 439/290 |
| 3,550,067 | A * | 12/1970 | Hansen | H01R 13/113 439/682 |
| 4,061,406 | A * | 12/1977 | Kunkle | H01R 13/28 439/291 |
| 5,259,796 | A * | 11/1993 | Yamada | H01R 13/113 439/843 |
| 5,533,914 | A * | 7/1996 | Sawada | H01R 13/187 439/843 |
| 5,549,483 | A * | 8/1996 | Hotea | H01R 4/185 439/399 |
| 5,899,775 | A * | 5/1999 | Davis | H01R 13/428 439/748 |

(Continued)

FOREIGN PATENT DOCUMENTS

| | | |
|---|---|---|
| DE | 10 2007 040 937 B3 | 1/2009 |
| DE | 10 2012 102 966 A1 | 10/2013 |

OTHER PUBLICATIONS

German Office Action, dated Dec. 2, 2016, 10 pages.
Abstract of DE102007040937, dated Jan. 15, 2009, 1 page.
Abstract of DE102012102966, dated Oct. 10, 2013, 1 page.

*Primary Examiner* — Thanh Tam T Le
(74) *Attorney, Agent, or Firm* — Barley Snyder

(57) ABSTRACT

A contact for an electrical connector comprises a body extending in a longitudinal direction. The body has a front surface. The front surface includes a first front section and a second front section. The second front section is offset with respect to the first front section in the longitudinal direction.

23 Claims, 11 Drawing Sheets

(56) References Cited

U.S. PATENT DOCUMENTS

| | | | | |
|---|---|---|---|---|
| 6,106,339 | A * | 8/2000 | Nagai | H01R 13/432 439/744 |
| 6,811,450 | B1 * | 11/2004 | Data | H01R 13/114 439/181 |
| 7,033,194 | B1 * | 4/2006 | Le Beau | H01R 13/11 439/290 |
| 7,044,813 | B2 * | 5/2006 | Amara | H01R 13/41 439/866 |
| 7,682,180 | B2 * | 3/2010 | Brown | H01R 13/4223 439/352 |
| 7,976,351 | B2 * | 7/2011 | Boemmel | H01R 13/432 439/748 |
| 8,079,863 | B2 * | 12/2011 | Wason | H01R 11/09 439/284 |
| 9,543,683 | B2 * | 1/2017 | Leonhardt | H01R 13/436 |

* cited by examiner

CONTACT AND ELECTRICAL CONNECTOR

CROSS-REFERENCE TO RELATED APPLICATION

This application claims the benefit of the filing date under 35 U.S.C. § 119(a)-(d) of German Patent Application No. 102016106717.2, filed on Apr. 12, 2016.

FIELD OF THE INVENTION

The present invention relates to a contact and, more particularly, to a contact for an electrical connector.

BACKGROUND

Known electrical connectors have a housing with a chamber and a contact disposed in the chamber. The contact has a body disposed between a contact section and a connecting section. As is known in the art, the contact is fixed in the chamber by a pair of contact locks. Electrical connectors have become increasingly compact; however, known contacts used in compact electrical connectors are not suitable for use in a high voltage range.

SUMMARY

A contact for an electrical connector according to the invention comprises a body extending in a longitudinal direction. The body has a front surface. The front surface includes a first front section and a second front section. The second front section is offset with respect to the first front section in the longitudinal direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
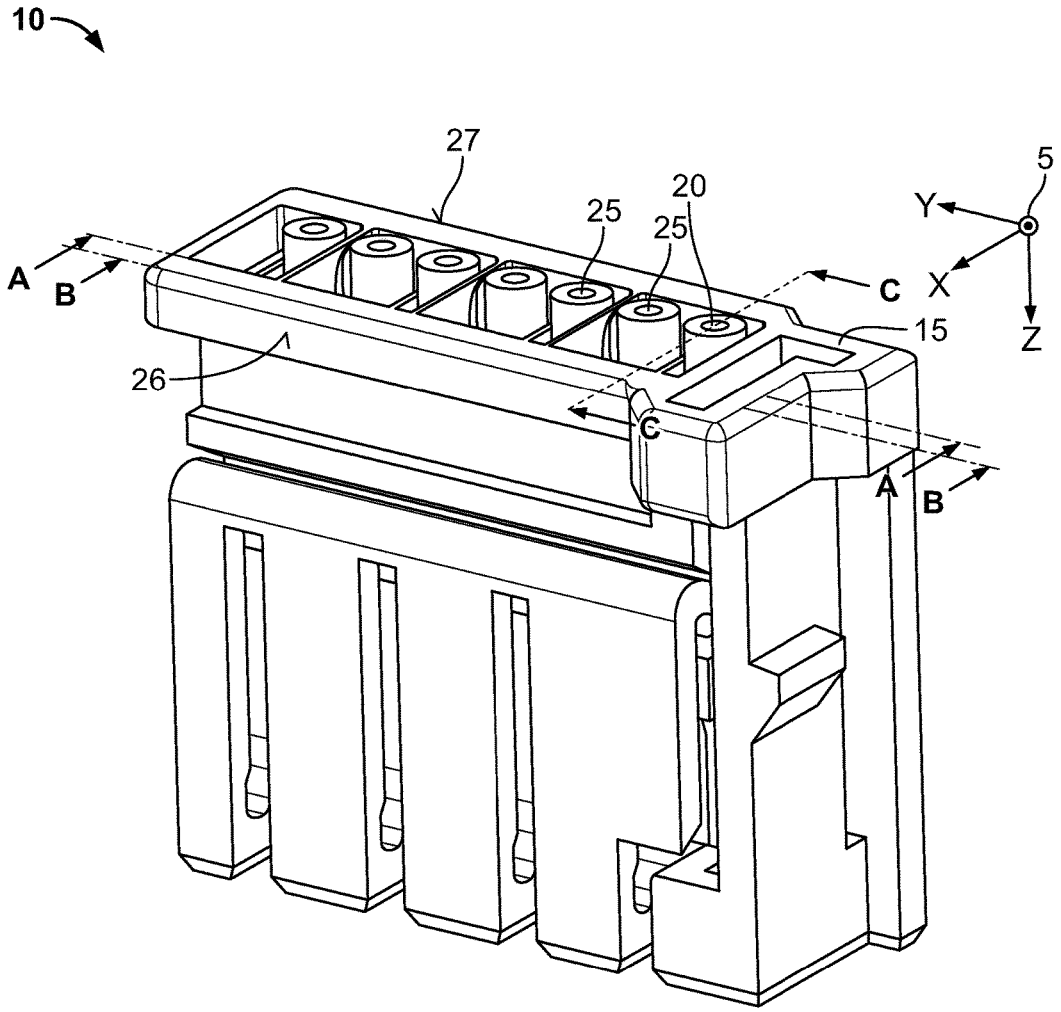
FIG. 1 is a perspective view of an electrical connector according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Reference is made to a coordinate system 5 shown in FIGS. 1-12 throughout the description. The coordinate system 5 is configured as a right-handed coordinate system and comprises an x-axis, a y-axis and a z-axis. The z-axis is described as the longitudinal direction and the y-axis is described as the transverse direction to the z-axis. The x-axis corresponds to a depth direction.

An electrical connector 10 according to the invention is shown in FIG. 1. The connector 10 comprises a housing 15, at least one first contact 20, and at least one second contact 25. In the shown embodiment, the first contact 20 and the second contact 25 are identical to one another.

Figure 2:
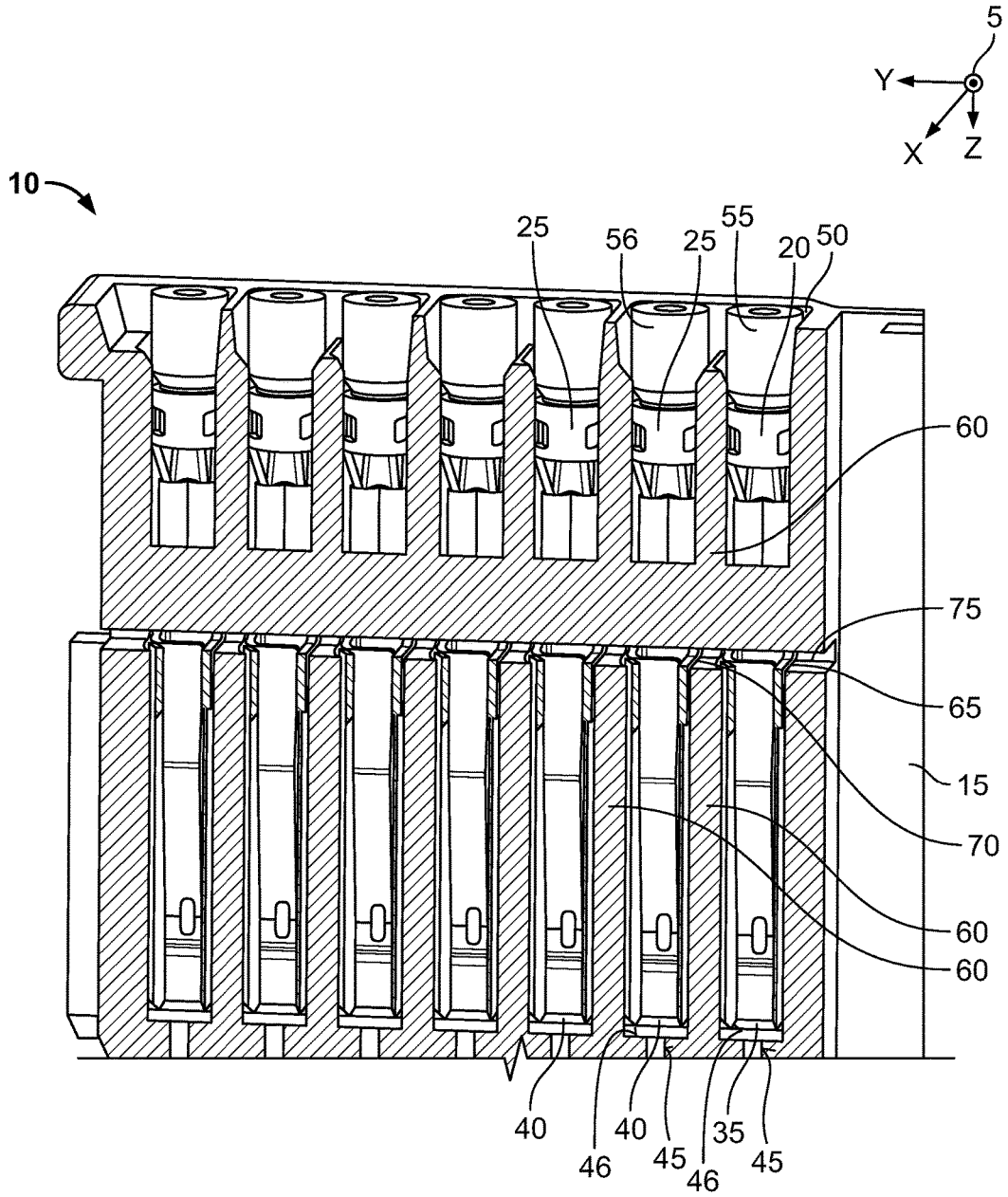
FIG. 2 is a sectional view of the connector taken along plane A-A of FIG. 1.
Figure 3:
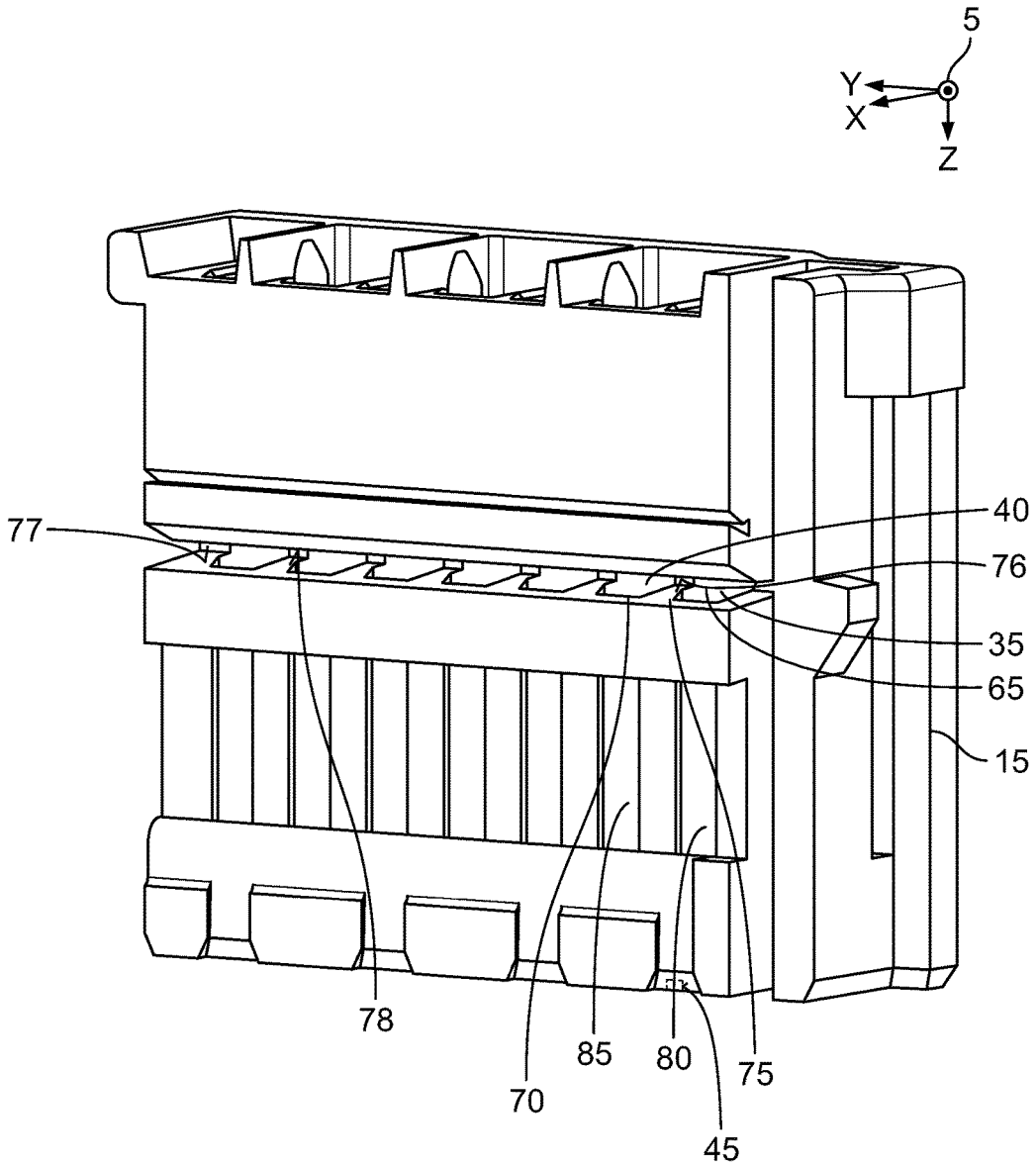
FIG. 3 is a perspective view of a housing of the connector of FIG. 1.

The housing 15 is shown in FIGS. 1-3. The housing 15 is formed of an electrically insulating material. The housing 15, as shown in FIG. 1, has a front side 26 and a rear side 27. The front side 26 and the rear side 27 extend, at least in sections, in different yz-planes.

The housing 15, as shown in FIG. 2, has at least one first chamber 35 and at least one second chamber 40. The first contact 20 is disposed in the first chamber 35 and the second contact 25 is disposed in the second chamber 40. In the shown embodiment, the first chamber 35 and the second chamber 40 are formed identically to one another. The first chamber 35 and the second chamber 40 are arranged parallel to one another and extend in the longitudinal direction. Each chamber 35, 40 comprises a first opening 45 on the lower side. Adjacent to the first opening 45 is a contact seat 46. The contact 20, 25 rests on the contact seat 46, as shown in FIG. 2, so that displaceability of the contact 20, 25 in the respective chamber 35, 40 is limited in the positive z-direction. Each chamber 35, 40 has a second opening 50 opposite the first opening 45. Between the first chamber 35 and the second chamber 40, the housing 15 comprises a chamber wall 60, which separates the first chamber 35 from the second chamber 40 and delimits both the first chamber 35 and the second chamber 40 in the transverse direction.

The housing 15, as shown in FIG. 2, has a first notch 65, a second notch 70, and a groove 75. The groove 75 is disposed on the front side 26 of the housing 15 and extends in the negative x-direction with reference to the coordinate system 5 toward the rear side 27 of the housing 15. The groove 75 extends in an xy-plane and is open on the front side 26. A depth of the groove 75 is selected such that the groove 75 extends through the first chamber 35 and forms the first notch 65 on the first chamber 35. In the embodiment shown in FIG. 2, the groove 75 extends over the entire transverse extension of the housing 15. The groove 75 thereby also extends through the second chamber 40 and forms the second notch 70 on the second chamber 40.

As shown in FIG. 3, the groove 75 comprises a groove bottom 76, a first groove side face 77 and a second groove side face 78. The first groove side face 77 and the second groove side face 78 are, in the shown embodiment, arranged in xy-planes with different offsets to one another in the longitudinal direction, wherein the first groove side face 77 is disposed below the second groove side face 78. The first groove side face 77 is disposed opposite the second groove side face 78. Between the first notch 65 and the first opening 45, the first chamber 35 comprises a first recess 80 extending in the longitudinal direction (z-direction). The second chamber 40 likewise comprises a second recess 85 extending in the longitudinal direction at the same level as the first recess 80 and configured identically to the first recess 80.

The contact 20, 25 is shown in FIGS. 4-7. The contact 20, 25 comprises a connecting section 90, a body 95 and a contacting device 100. In the longitudinal direction, the body 95 is disposed between the contacting device 100 and the connecting section 90 and is connected at the upper end to the connecting section 90 and at the lower end to the contacting device 100. The body 95 has a square cross-section. The cross-section of the body 95 is tapered in the positive x-direction.

Figure 4:
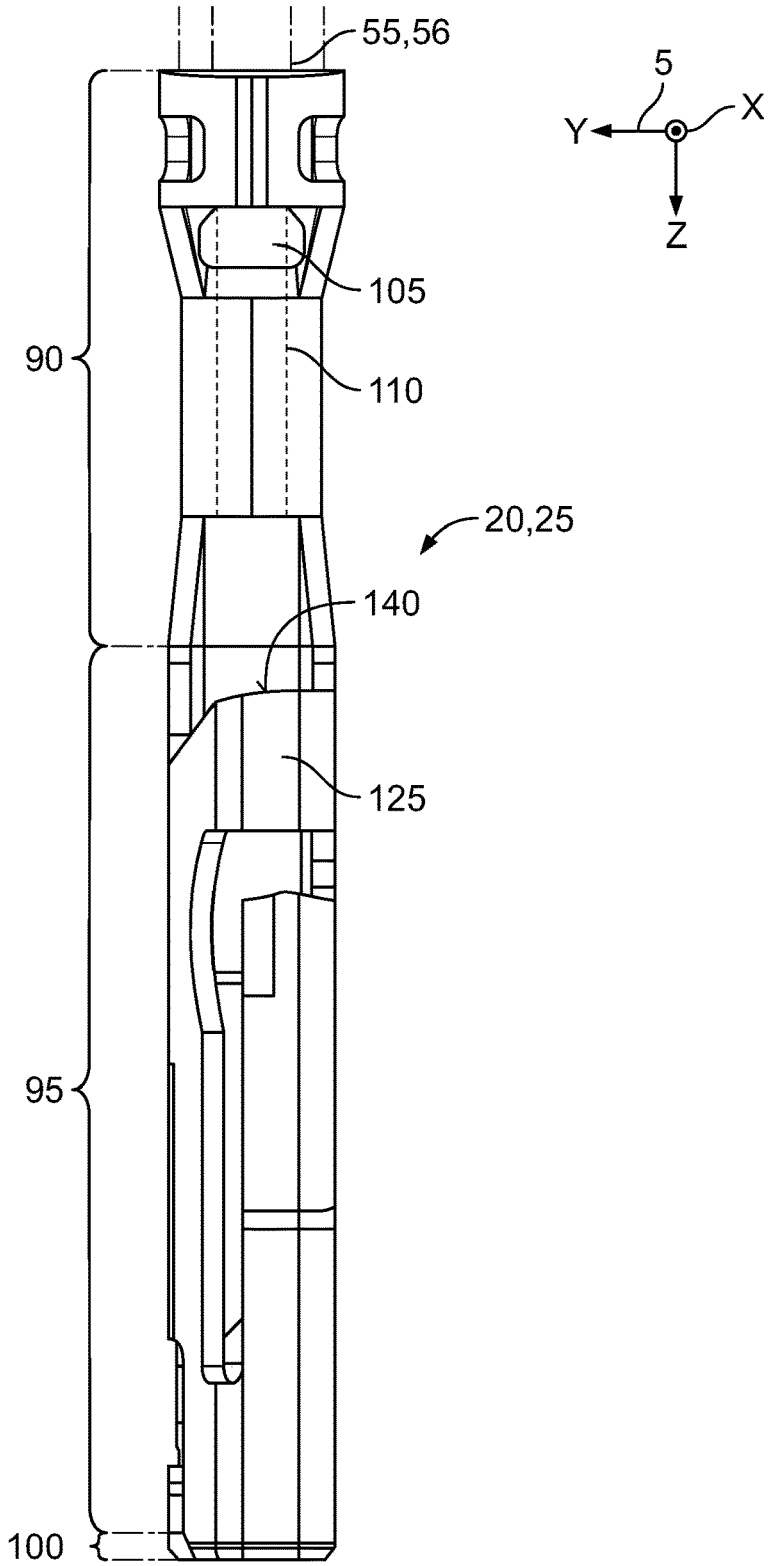
FIG. 4 is a front view of a contact of the connector of FIG. 1.

The connecting section 90, as shown in FIG. 4, connects to an electrical line 55, 56. The first contact 20 is connected to a first electrical line 55 and the second contact 25 is connected to a second electrical line 56. An electrical conductor 105 of the electrical line 55, 56 is crimped to form a connection 110 to the connecting section 90.

Figure 5:
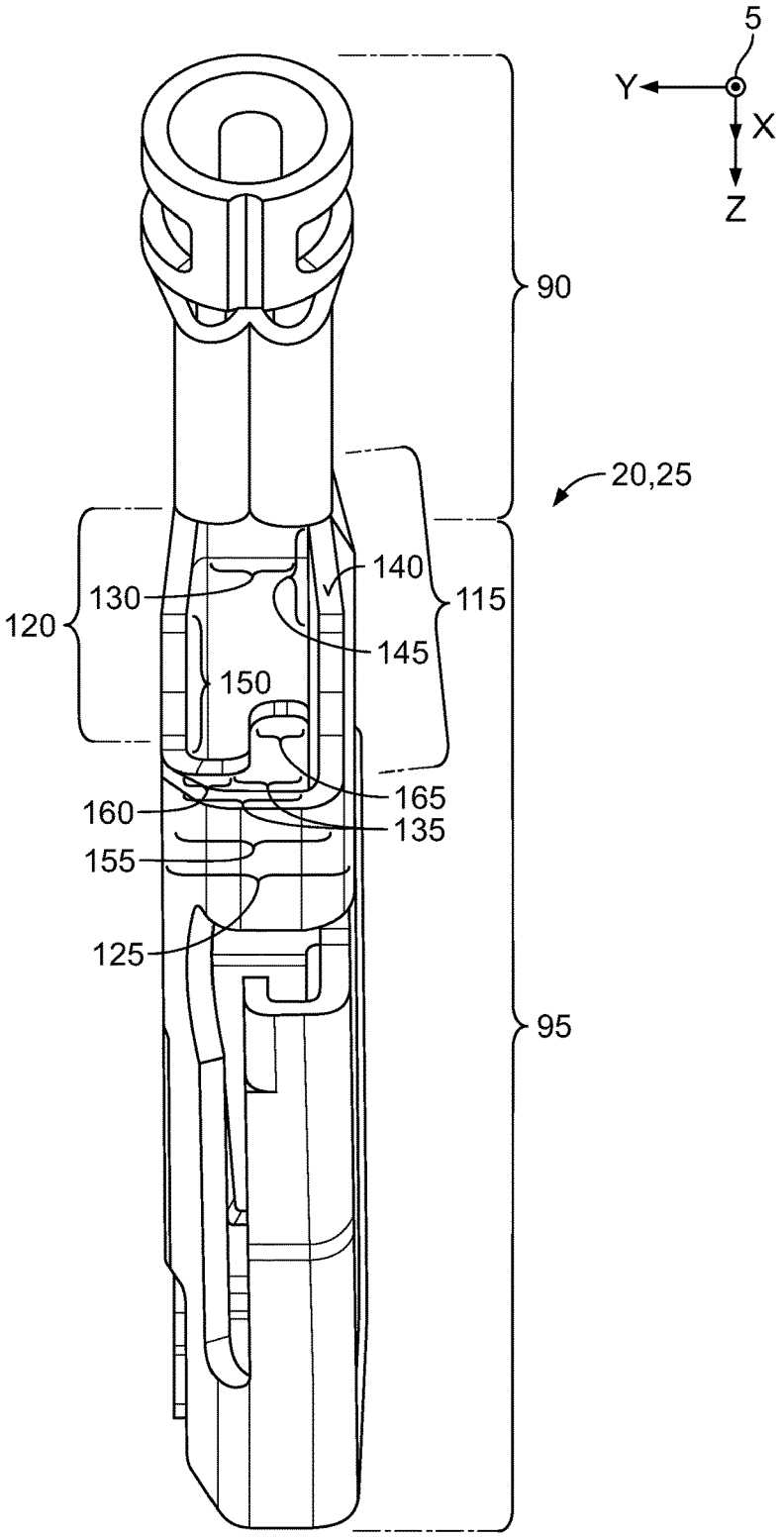
FIG. 5 is a perspective view of the contact of FIG. 4.
Figure 6:
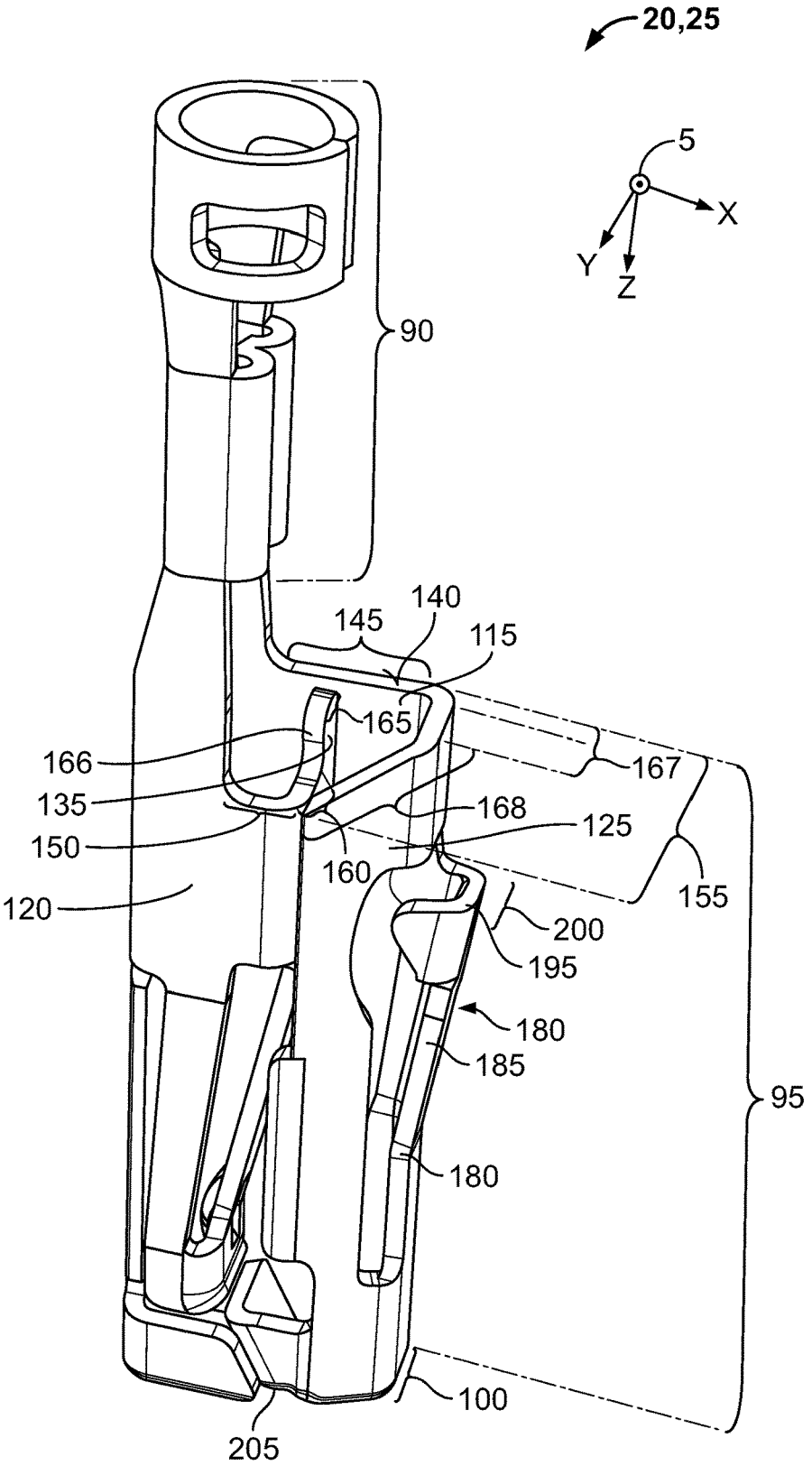
FIG. 6 is another perspective view of the contact of FIG. 4.

The body 95, as shown in FIGS. 5 and 6, comprises a first body section 115, a second body section 120, a third body section 125, a fourth body section 130, and a fifth body section 135.

The first body section 115 and the second body section 120, as shown in FIGS. 5 and 6, extend in the longitudinal direction. The first body section 115 is arranged at a distance from the second body section 120 in the transverse direction (y-direction). The first body section 115 and the second body section 120 extend parallel to one another in the longitudinal direction. On the rear side, the first body section 115 and the second body section 120 are connected to the fourth body section 130, so that the first body section 115, the second body section 120 and the fourth body section 130 are arranged in the shape of a U with respect to one another. The fourth body section 130 is at an angle with respect to the first body section 115 and the second body section 120.

The third body section 125 is arranged on a side opposite the fourth body section 130 (in the x-direction) with an offset to the fourth body section 130. The third body section 125 can be tongue-shaped or configured flat or L-shaped, as shown in FIGS. 5 and 6. The third body section 125 is connected on one side to the first body section 115. A free end of the third body section 125 contacts the second body section 120. The third body section 125 is not connected to the second body section 120. The third body section 125 is disposed inclined to the first body section 115 and the second body section 120.

The fifth body section 135, as shown in FIGS. 5 and 6, is arranged in the x-direction between the third body section 125 and the fourth body section 130. The fifth body section 135 thereby extends, at least in sections, parallel to the fourth body section 130. The fifth body section 135 stiffens the body 95. In the shown embodiment, the fifth body section 135 is connected to the second body section 120 on a side facing away from the first body section 115. A free end of the fifth body section 135 contacts an inner side of the first body section 115. The third body section 125 extends around an outer side of the fifth body section 135.

The body 95, as shown in FIGS. 5 and 6, comprises a front surface 140 on a side facing the connecting section 90. The front surface 140 comprises a first front section 145, a second front section 150, a third front section 155, a fourth front section 160, and a fifth front section 165. The first front section 145 is arranged on the first body section 115. The second front section 150 is arranged on the second body section 120. The third front section 155 is arranged on the third body section 125. The fourth body section 130 is connected to the connecting section 90, so that none of the front sections 145, 150, 155, 160, 165 is arranged on the fourth body section 130. The fourth front section 160 and the fifth front section 165 are arranged on the fifth body section 135.

The first front section 145, as shown in FIG. 6, is connected to the third front section 155. The third front section 155 is configured in an L-shape and comprises a first region 167 and a second region 168. The first region 167 of the third front section 155 is disposed between the second region 168 of the third front section 155 and the first front section 145 and is connected to the first front section 145 and the second region 168 of the third front section 155. The first region 167 of the third front section 155 is perpendicular to the first front section 145. The first region 167 of the third front section 155 and the first front section 145 extend in a common xy-plane. The second region 168 of the third front section 155 is arranged obliquely inclined in the direction of the second front section 150.

The second front section 150 and the fourth front section 160, as shown in FIG. 6, are connected to one another. A shoulder 166 is disposed between the fourth front section 160 and the fifth front section 165. The shoulder 166 connects the fourth front section 160 to the fifth front section 165. The shoulder 166 is offset with respect to the first front section 145 and the second front section 150 in the y-direction.

The first front section 145 and the second front section 150, as shown in FIG. 6, extend parallel in the x-direction and are offset with respect to one another in the transverse direction and in the longitudinal direction. The fourth front section 160 and the fifth front section 165 extend perpendicularly to the second front section 150. The fourth front section 160 and the fifth front section 165 are, in the shown embodiment, arranged at approximately half the depth of the first front section 145.

Figure 7:
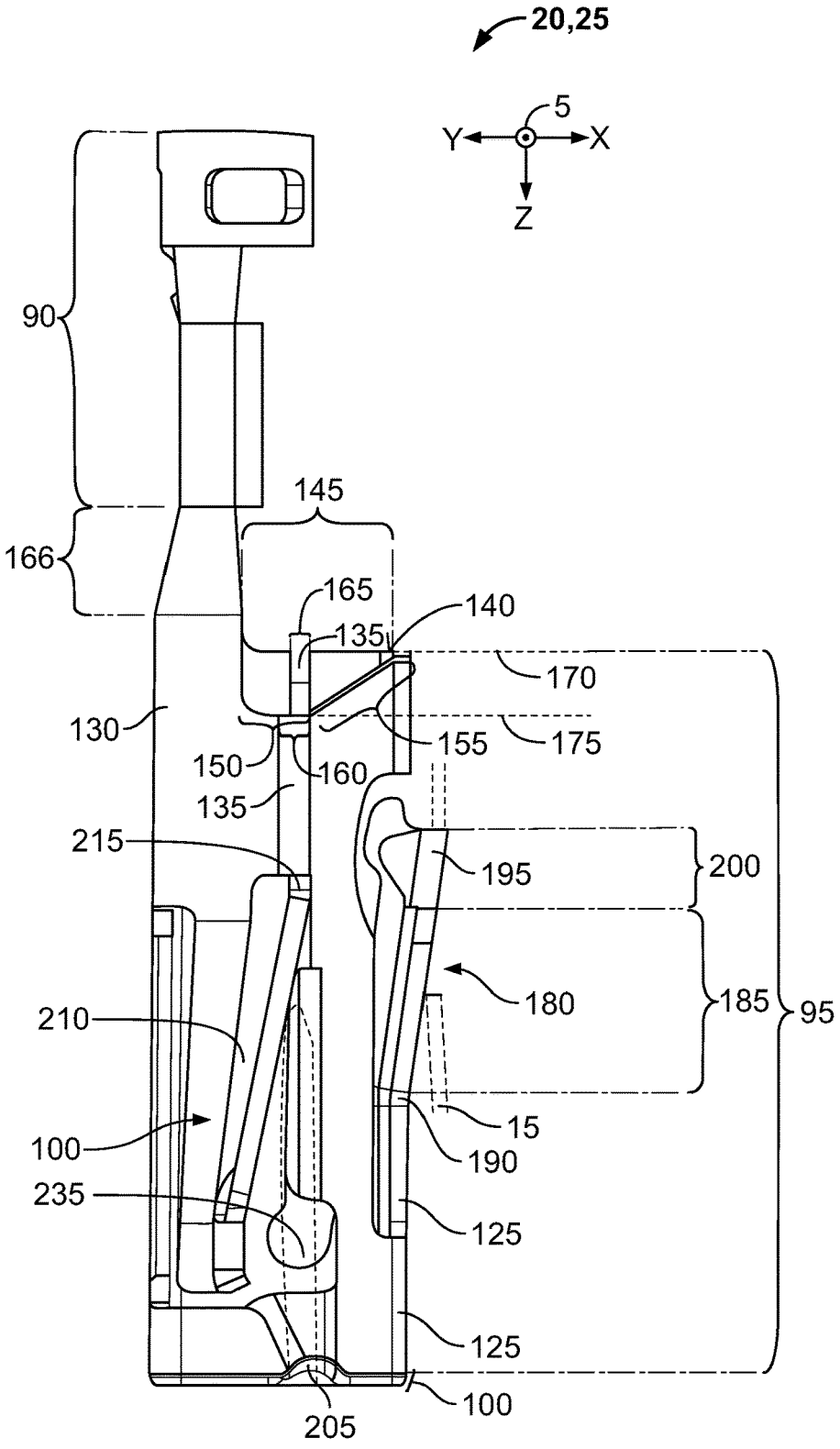
FIG. 7 is a side view of the contact of FIG. 4.

The first front section 145, as shown in FIGS. 6 and 7, is arranged in a first xy-plane 170 perpendicularly to the longitudinal direction (z-direction) and is flat. The second front section 150 is arranged in a second xy-plane 175 and is likewise flat. The second front section 150 is parallel to the first front section 145. The second region 168 of the third front section 155 is oblique to the first front section 145 and the second front section 150. The second region 168 of the third front section 155 extends between the level of the first front section 145 and of the first region 167 of the third front section 155 to the level of the second front section 150. The fourth front section 160 is arranged in the second plane 175 and the fifth front section 165 is arranged in the first plane 170.

The contact 20, 25, as shown in FIGS. 6 and 7, has a latching arm 180. The latching arm 180 is offset from the front surface 140 in the direction of the contacting device 100. The latching arm 180 comprises a cantilevered arm 185 and an engagement section 200. A fixed end 190 of the cantilevered arm 185 is connected to the third body section 125. At a free end 195 of the cantilevered arm 185, the latching arm 180 has the engagement section 200.

The contacting device 100, as shown in FIG. 7, has a socket 205 and a pressing arm 210. In the shown embodiment, the contacting device 100 is a female contact. The pressing arm 210 is a cantilever with a fixed end 215 attached to the fifth body section 135. The pressing arm 210 is disposed between the socket 205 and the fifth body section 135 in the longitudinal direction. The pressing arm 210 presses a male contact 235 guided through the socket 205. The contact 20, 25 comprises an electrically conducting material. As a result, a reliable electrical connection can be ensured between the male contact 235 and the contact 20, 25.

An assembly of the connector 10 having the housing 15 with the contacts 20, 25 will now be described in greater detail with reference to FIGS. 1 and 8-12.

Figure 10:
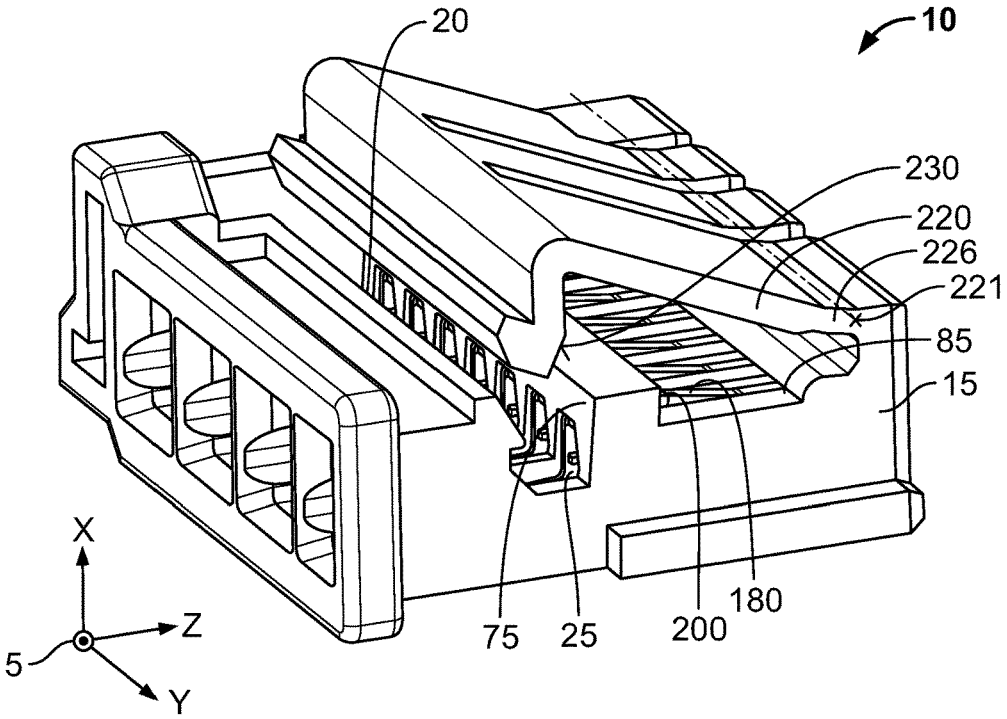
FIG. 10 is a perspective view of the connector of FIG. 1 with a contact lock of the connector in an open position.

The contacts 20, 25, as shown in FIG. 1, are arranged in the housing 15 next to one another at a distance in a common yz-plane. The latching arm 180 engages the recess 80, 85 associated with the contact 20, 25, as shown in FIG. 10, in order to restrict displaceability of the contact 20, 25 in the chamber 35, 40 relative to the housing 15 in at least the negative z-direction.

Figure 8:
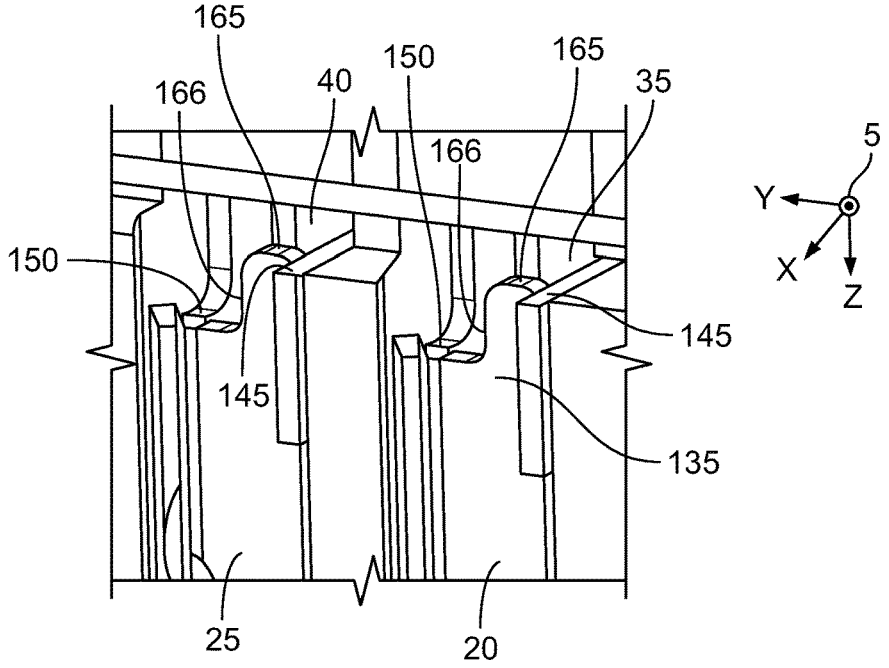
FIG. 8 is a detail view of the connector of FIG. 1.

The second front section 150 of the first contact 20, as shown in FIG. 8, is disposed adjacent the second contact 25 and the first front section 145 of the first contact 20 is disposed further from the second contact 25. The first front section 145 of the second contact 25 is disposed adjacent the second front section 150 of the first contact 20 and the second front section 150 of the second contact 25 is disposed further from the second front section 150 of the first contact 20.

Figure 9:
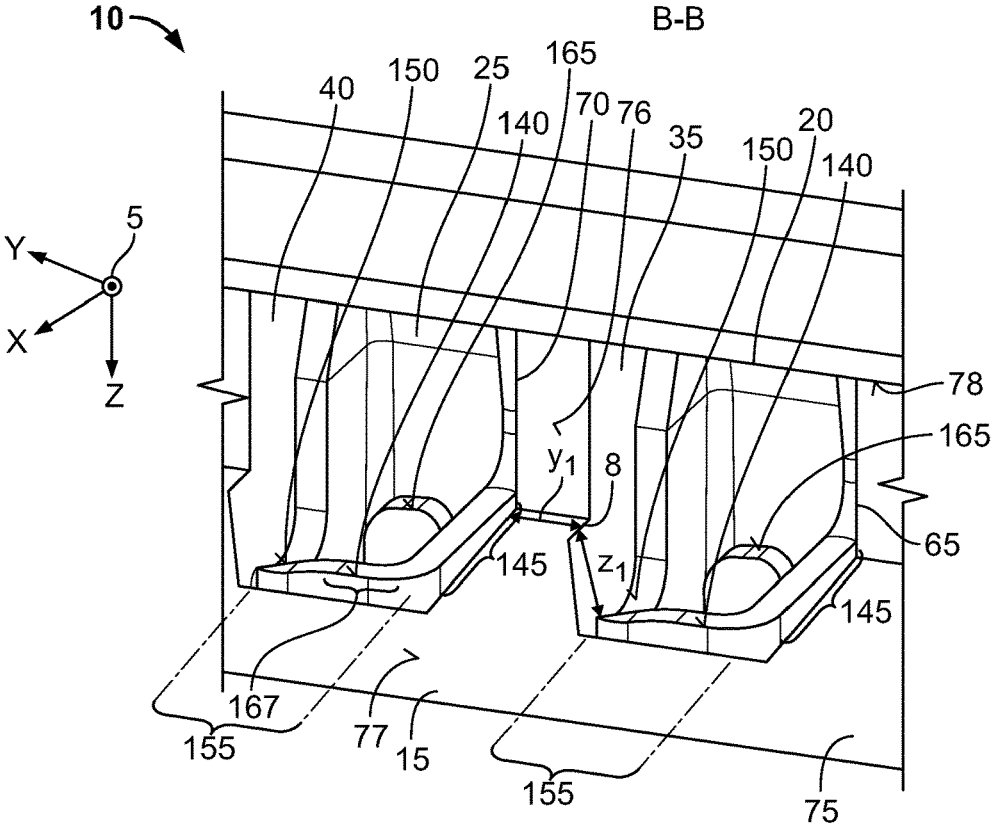
FIG. 9 is a detailed sectional view of the connector taken along plane B-B of FIG. 1.

As shown in FIG. 9, the first notch 65 of the housing 15 and the first front section 145 of the first contact 20 are arranged at the same level in the longitudinal direction. In the z-direction, the first front section 145 of the first contact 20 is arranged in a common xy-plane with the first groove side face 77 of the housing 15. The first front section 145 projects in the x-direction beyond a yz-plane in which the groove bottom 76 of the housing 15 is arranged. The second front section 150 is offset in the longitudinal direction with respect to the first notch 65 in the direction of the contacting device 100 and the contact seat 46 of the housing 15. The first region 167 of the third front section 155 extends at the level of the first notch 65. The fifth front section 165 of the first contact 20 is arranged at the level of the first notch 65 and the fourth front section 160 of the first contact 20 is arranged with an offset to the first notch 65.

The arrangement of the second contact 25 in the second chamber 40 in FIG. 9 is similar to the arrangement of the first contact 20 in the first chamber 35. The first front section 145 and the fifth front section 165 of the second contact 20 are arranged at the level of the second notch 70 in the longitudinal direction. The second front section 150 and the fourth front section 160 of the second contact 25 are arranged with an offset to the second notch 70 in the longitudinal direction. The third front section 155 of the second contact 25 extends in sections at the level of the second notch 70.

The connector 10 has a particularly long creepage distance from the first contact 20 to the second contact 25. The creepage distance is the shortest distance along a surface of an electrically insulating material, the housing 15 of the connector 10 in the shown embodiments, between the first contact 20 and the second contact 25. As a result, the connector 10 is particularly suitable for transferring high voltages across the contacts 20, 25. Due to the offset arrangement of the second front section 150 of the first contact 20 to the first front section 145 of the second contact 25, as shown in FIG. 9, the creepage distance is a sum of a first distance y1 in the y-direction and of a second distance z1 in the z-direction. The first distance y1 extends in the y-direction along the first groove side face 77 between the first notch 65 and the second notch 70. The second distance z1 extends from the second front section 150 of the first contact 20 in the z-direction along the chamber wall 60 to the first groove side face 77.

In comparison to known connectors, the creepage distance of the contacts 20, 25 in the connector 10 is longer by the second distance z1. The shoulder 166 and the oblique arrangement of the second region 168 of the third front section 155 further ensure that the creepage distance extends between the first front section 145 of the second contact 25 and the second front section 150 of the first contact 20. Due to the increased creepage distance, a voltage can be increased for the connector 10 having the contacts 20, 25 without requiring modification of the housing 15.

Figure 11:
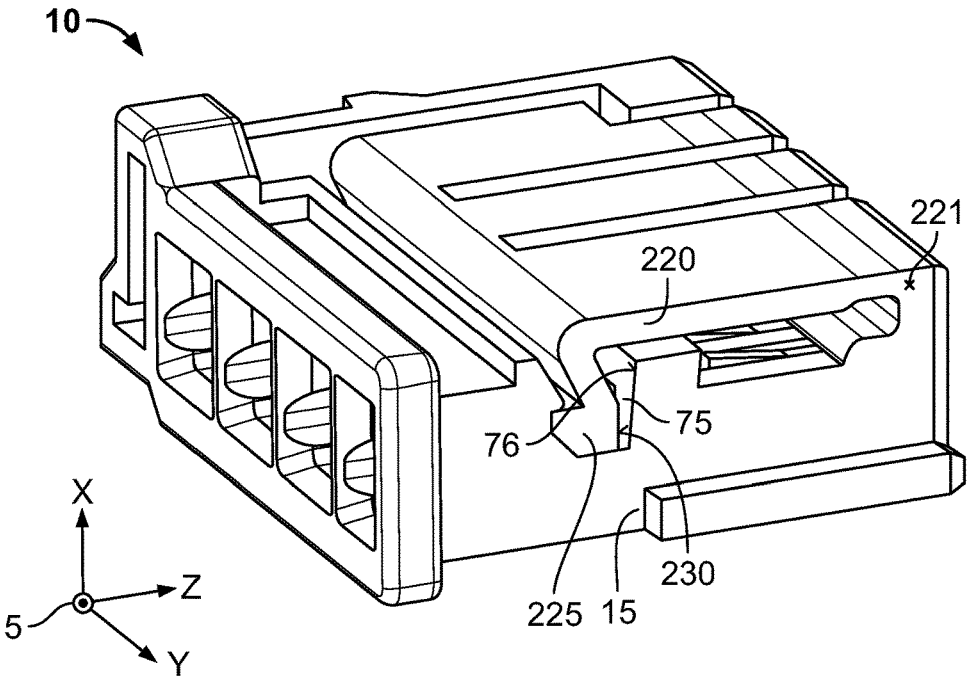
FIG. 11 is a perspective view of the connector of FIG. 1 with the contact lock in a closed position.
Figure 12:
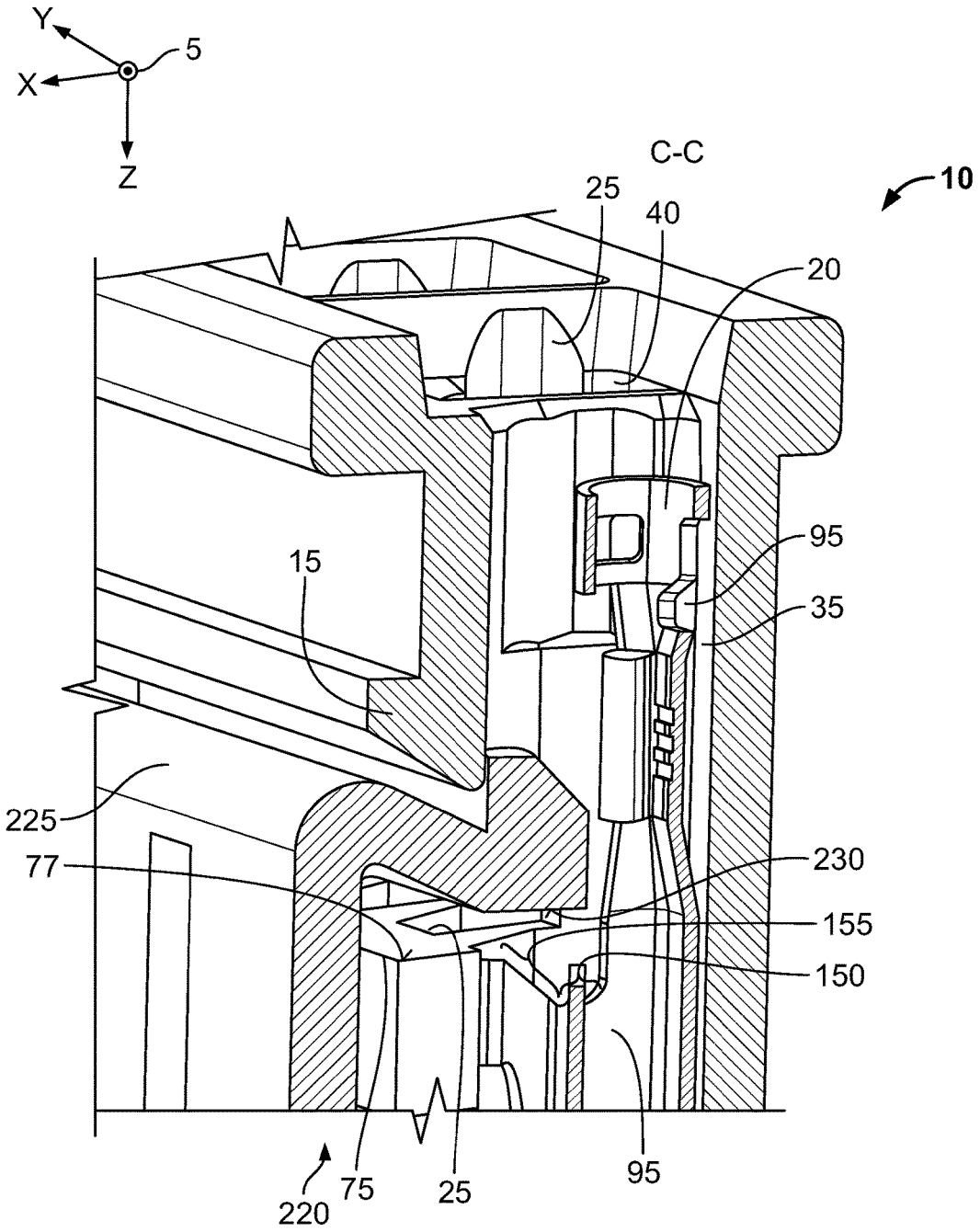
FIG. 12 is a sectional view of the connector taken along plane C-C of FIG. 1.

The connector 10, as shown in FIGS. 10-12, has a contact lock 220. The contact lock 220 has a locking element 225, which can be pivoted about a pivot axis 221 between an open position shown in FIG. 10 and a closed position shown in FIG. 11. The locking element 225 is connected at one end 226 to the housing 15. The locking element 225 has a stop surface 230 at an opposite end. The stop surface 230 is disposed on a side of the locking element 225 which faces away from the connecting section 90 and extends diagonally to an xy-plane.

In the closed position shown in FIGS. 11 and 12, the locking element 225 engages the groove 75, the first notch 65, and the second notch 70. The stop surface 230 is disposed in an xy-plane in the closed condition opposite the first front section 145 and the first groove side face 176 in the longitudinal direction. If the contact 20, 25 is tensioned in a negative z-direction by the electrical line 55, 56, the first front section 145 contacts the stop surface 230 and the stop surface 230 prevents further displacement of the contact 20, 25 in the negative z-direction in the chamber 35, 40 relative to the housing 15. The second front section 150 is arranged at a distance from the stop surface 230 in the z-direction when the first front section 145 contacts the stop surface 230.

As an alternative to the arrangement of the first front section 145 with respect to the groove 75 shown in FIGS. 9 to 12, the first front section 145 may be arranged with an offset to the notch 65, 70 in the direction of the contacting device 100. The second front section 150 is, in this case, also arranged with an offset in the direction of the contacting device 100.

Figure 13:
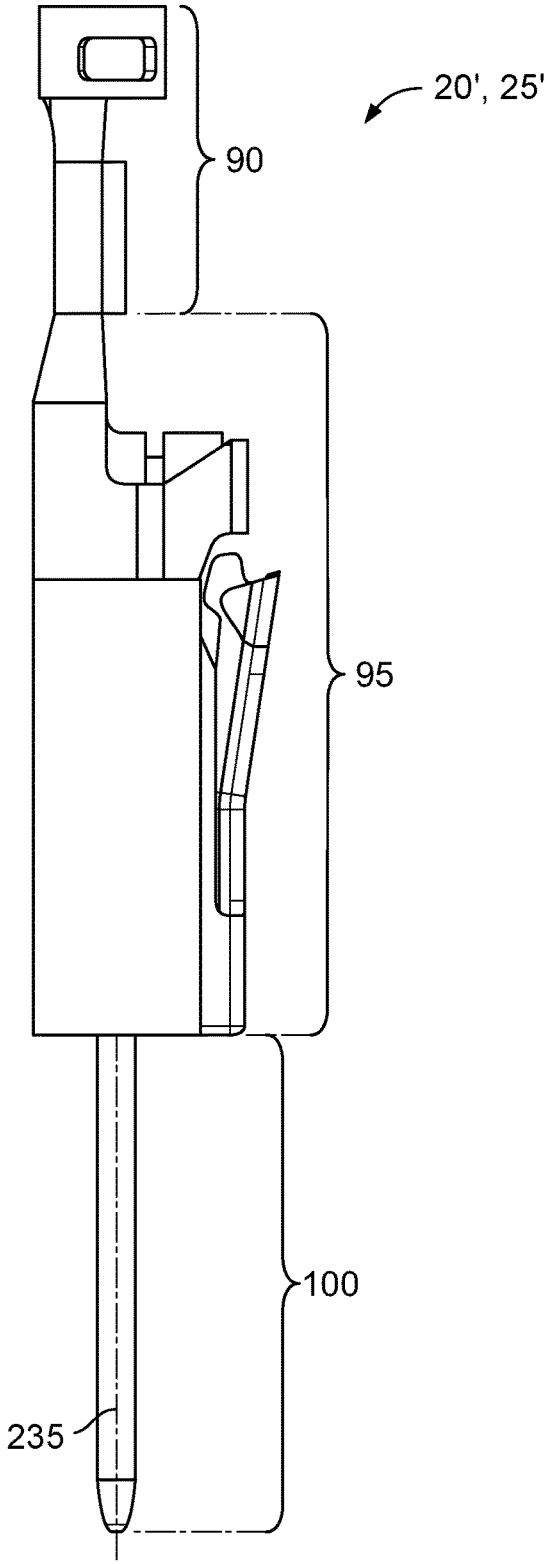
FIG. 13 is a side view of a contact according to another embodiment of the invention.

A contact 20', 25' according to another embodiment of the invention is shown in FIG. 13. The contact 20', 25' is similar to the contact 20, 25 described with reference to FIGS. 1-12, and only differences from the contact 20, 25 will be described herein.

The contact 20', 25' does not have the pressing arm 210 and the contacting device 100 is configured as a male contact 235. The male contact 235 is inserted into the socket 205 shown in FIGS. 6 and 7, forming an electrical connection between the contact 20, 25 and the contact 20', 25'. Due to the identical configuration of the body 95 and the connecting section 90, the contact 20', 25' can be inserted into the housing 15 without requiring changes to the housing 15. As a result, the housing 15 is usable both for the contact 20, 25 and for the contact 20', 25'.

What is claimed is:

1. A contact for an electrical connector, comprising:

a body extending in a longitudinal direction and having a front surface that includes a first front section and a second front section offset posteriorly with respect to the first front section in the longitudinal direction, and another front section positioned anterior with respect to the first front section and the second front section, the another front section extending perpendicular to the second front section at approximately half a depth of the first front section in a depth direction perpendicular to the longitudinal direction.

2. The contact of claim 1, wherein the first front section is flat and is disposed in a plane perpendicular to the longitudinal direction and the second front section extends obliquely or parallel to the first front section.

3. The contact of claim 2, wherein the body has a square cross-section and comprises a first body section extending in the longitudinal direction and a second body section extending in the longitudinal direction at a distance from the first body section.

4. The contact of claim 3, wherein the first front section of the front surface is disposed on the first body section and the second front section of the front surface is disposed on the second body section.

5. The contact of claim 4, wherein the front surface has a third front section connected to the first front section and inclined with respect to the first front section.

6. The contact of claim 5, wherein the body has a third body section connected to the first body section and inclined with respect to the first body section and the second body section.

7. The contact of claim 6, wherein the third front section of the front surface is disposed on the third body section.

8. The contact of claim 7, further comprising a connecting section connected to the body and electrically connected to an electrical line, the front surface of the body facing the connecting section.

9. The contact of claim 8, wherein the body has a fourth body section:

(a) extending in the longitudinal direction, (b) connected to the connecting section, (c) connecting the first body section to the second body section, and (d) disposed opposite the third body section.

10. The contact of claim 1, further comprising a contacting device connected to the body, the front surface of the body facing away from the contacting device.

11. The contact of claim 10, wherein the contacting device has a male contact or a female contact.

12. The contact of claim 1, wherein the first front section is flat and is disposed in a plane perpendicular to the longitudinal direction and the second front section extends obliquely to the first front section.

13. An electrical connector, comprising:

a housing having a first chamber; and a first contact disposed in the first chamber and having a body extending in a longitudinal direction, the body having a front surface including a first front section and a second front section offset posteriorly with respect to the first front section in the longitudinal direction, and another front section positioned anterior with respect to the first front section and the second front section, the another front section extending perpendicular to the second front section at approximately half a depth of the first front section in a depth direction perpendicular to the longitudinal direction.

14. The electrical connector of claim 13, wherein the housing has a recess on the first chamber and the first contact has a latching arm connected to the body, the latching arm engaging the recess and securing the first contact in the first chamber.

15. The electrical connector of claim 13, wherein the housing has a second chamber extending parallel to the first chamber, the electrical connector further comprising a second contact formed identically to the first contact and disposed in the second chamber.

16. The electrical connector of claim 15, wherein the second front section of the first contact is disposed adjacent the second contact and the first front section of the first contact is disposed further from the second contact than the second front section of the first contact.

17. The electrical connector of claim 16, wherein a first front section of the second contact is disposed adjacent the second front section of the first contact and a second front section of the second contact is disposed further from the first contact than the first front section of the second contact.

18. The electrical connector of claim 17, further comprising a contact lock having a locking element with a stop surface.

19. The electrical connector of claim 18, wherein the housing has a first notch disposed on the first chamber and a second notch disposed on the second chamber, the locking element engaging the first notch and the second notch and securing the first contact and the second contact in the housing.

20. An electrical connector comprising:

a housing having:

(a) a first chamber, and (b) a second chamber extending parallel to the first chamber;

a first contact disposed in the first chamber and having:

(a) a body extending in a longitudinal direction, and (b) a front surface including:

(1) a first front section, and (2) a second front section offset with respect to the first front section in a longitudinal direction; and a second contact, formed identically to the first contact and disposed in the second chamber, and having:

(a) a first front section disposed adjacent the second front section of the first contact, and (b) a second front section disposed further from the first contact than the first front section of the second contact; and a contact lock having a locking element with a stop surface:

(a) contacting the first front section of the first contact and the first front section of the second contact, and (b) at a distance from:

(1) the second front section of the first contact, and (2) the second front section of the second contact.

21. An electrical connector comprising:

a housing having:

(a) a first chamber, and (b) a first notch disposed on the first chamber in a longitudinal direction; and a first contact disposed in the first chamber and having:

(a) a body extending in a longitudinal direction, and (b) a front surface including:

(1) a first front section disposed at the same level in the longitudinal direction as the first notch, (2) a second front section disposed:

(i) offset with respect to the first notch in the longitudinal direction, and (ii) offset posteriorly with respect to the first front section in a longitudinal direction, and (3) another front section positioned anterior with respect to the first front section and the second front section, the another front section:

(i) extending perpendicular to the second front section at approximately half a depth of the first front section, and (ii) extending in a depth direction perpendicular to the longitudinal direction.

22. An electrical connector, comprising:

a housing having:

(a) a first chamber, (b) a first notch on the first chamber, (c) a second chamber extending parallel to the first chamber, and (d) a second notch on the second chamber;

a first contact in the first chamber and having a body extending in a longitudinal direction and having a front surface including:

(a) a first front section, (b) a second front section offset in the longitudinal direction with respect to the first front section, and (c) another front section extending from and perpendicular to the second front section;

a second contact:

(a) identical to the first contact, (b) in the second chamber, (c) adjacent the second front section of the first contact and the first front section of the first contact further from the second contact than the second front section of the first contact, (d) having a first front section disposed adjacent the second front section of the first contact, and (e) having a second front section further from the first contact than the first front section of the second contact; and a contact lock having a locking element:

(a) engaging the first notch and the second notch, (b) securing the first contact and the second contact in the housing, and (c) having a stop surface:

(1) contacting the first front section of the first contact, (2) contacting the first front section of the second contact, and (3) positioned at a distance from:

(i) the second front section of the first contact, and (ii) the second front section of the second contact.

23. The electrical connector of claim 22, wherein the first notch and the first front section of the first contact are disposed at a same level in the longitudinal direction and the second front section of the first contact is disposed offset with respect to the first notch in the longitudinal direction.

* * * * *